US011344118B2

(12) United States Patent
Baleani

(10) Patent No.: US 11,344,118 B2
(45) Date of Patent: May 31, 2022

(54) DEVICE FOR CARRYING CONTAINERS

(71) Applicant: SIGE S.P.A., Polverigi An (IT)

(72) Inventor: Edoardo Baleani, Agugliano Ancona (IT)

(73) Assignee: SIGE S.P.A., Polverigi (IT)

( * ) Notice: Subject to any disclaimer, the term of this patent is extended or adjusted under 35 U.S.C. 154(b) by 0 days.

(21) Appl. No.: 17/370,550

(22) Filed: Jul. 8, 2021

(65) Prior Publication Data

US 2022/0015539 A1 Jan. 20, 2022

(30) Foreign Application Priority Data

Jul. 14, 2020 (IT) ..... 102020000017080

(51) Int. Cl.

| | |
|---|---|
| ***A47B 77/18*** | (2006.01) |
| ***A47B 88/988*** | (2017.01) |
| ***A47B 88/919*** | (2017.01) |
| ***A47B 88/994*** | (2017.01) |
| ***A47B 88/969*** | (2017.01) |

(52) U.S. Cl.

CPC ..... *A47B 77/18* (2013.01); *A47B 88/919* (2017.01); *A47B 88/988* (2017.01); *A47B 88/994* (2017.01); *A47B 2088/976* (2017.01)

(58) Field of Classification Search

CPC ... A47B 88/407; A47B 88/0407; A47B 88/42; A47B 88/0485; A47B 88/427; A47B 88/0422; A47B 88/969; A47B 88/988; A47B 88/994; A47B 2088/976; A47B 2088/205; A47B 2210/01; A47B 2210/09; A47B 77/18

See application file for complete search history.

(56) References Cited

U.S. PATENT DOCUMENTS

| | | | | |
|---|---|---|---|---|
| 4,887,538 A | 12/1989 | Arnold | | |
| 2002/0024276 A1 * | 2/2002 | Neuhaus | ..... | A47B 77/18 312/351.7 |

FOREIGN PATENT DOCUMENTS

| | | | | |
|---|---|---|---|---|
| CA | 3004861 A1 * | 11/2018 | ..... | A47B 77/18 |
| DE | 202005016305 U1 * | 8/2006 | ..... | A47B 77/18 |
| DE | 202010000629 U1 * | 5/2011 | ..... | A47B 88/994 |
| DE | 202014102726 U1 * | 9/2015 | ..... | A47B 77/18 |
| DE | 202016002630 U1 | 7/2016 | | |
| DE | 202017102855 U1 * | 8/2018 | ..... | A47B 88/90 |
| TW | 201416029 A | 5/2014 | | |

OTHER PUBLICATIONS

Italian Search Report dated Jan. 28, 2021 from counterpart Italian Patent Application No. 102020000017080.

European Office Action dated Nov. 9, 2021 from counterpart European Patent Application No. 21 18 5111.

* cited by examiner

*Primary Examiner* — Andrew M Roersma

(74) *Attorney, Agent, or Firm* — Shuttleworth & Ingersoll, PLC; Timothy Klima

(57) ABSTRACT

Described is container carrying device, installed or which can be installed in a drawer of a furniture item equipped with two side panels which are opposite to each other, wherein each of the side panels include guides which slidably constrain respective side panels of the drawer. The device includes a frame defining at least one seat designed to support a respective container and two shoulders connectable to the side panels. The device also includes a pair of supports configured for reversibly connecting the frame to the side panels.

9 Claims, 6 Drawing Sheets

DEVICE FOR CARRYING CONTAINERS

This application claims priority to Italian Patent Application 102020000017080 filed Jul. 14, 2020, the entirety of which is incorporated by reference herein.

BACKGROUND OF THE INVENTION

This invention relates to the sector of manufacturing accessories for furniture.

More specifically, the invention relates to a device for carrying containers.

Moreover, the invention relates to an assembly kit and a furniture item comprising said device.

SUMMARY OF THE INVENTION

More specifically, the invention finds use in a domestic context, wherein the device is preferably used as a waste container holder, in particular for separately collecting waste.

Moreover, the invention may be widely used as a container carrier for other types of material, such as, for example (and without limiting the scope of the invention), linen to be washed and the like.

There are many types of furniture items available on the market designed for waste collection.

In general, these furniture items are equipped with internal side and opposite panels on which are installed guides which slidably constrain respective side panels of a concealed drawer.

The panels are typically connected to the devices for carrying containers which comprise a frame designed to support the containers and at least two supports configured for reversibly and stably connecting the frame to the panels.

The device just described, although it is made in numerous variations, has several important drawbacks which means its use does not have very high performance levels.

Typically, in effect, the devices for carrying containers and the drawers (and the relative side panels) are made by different manufacturers.

It follows that, in order to render the supports compatible with a specific and predetermined model of drawer, the supports must be made "ad hoc" (that is, dedicated to the drawer manufacturer) as a function of the shape of the side panels of the drawer.

For this reason, the supports are not very versatile and typically cannot be used for drawers produced by different manufacturers.

A further problem is linked to the structural complexity of the prior art devices, which make their installation onerous in terms of time.

Moreover, this structural complexity may allow them to be damaged and/or broken.

In light of the above, the technical purpose of the invention is to provide a device for carrying containers, an assembly kit and a furniture item which are able to overcome the above-mentioned drawbacks.

An aim of this invention is to provide a device which is extremely versatile in such a way as to be able to adapt to a wide range of side panels and, consequently, in such a way that it can be installed in a wide range of furniture items from different manufacturers.

A further aim of the invention is to provide a device for carrying containers and an assembly kit which can be easily installed in any type of furniture item.

The technical purpose indicated and the aims specified are substantially achieved by a container carrying device, an assembly kit and a furniture item comprising one or more of the technical features described in the appended claims. The dependent claims correspond to possible embodiments of the invention.

In particular, the technical purpose indicated and the aims specified are substantially achieved by a device for carrying containers, installed or which can be installed in a drawer of a furniture item equipped with two side panels opposite to each other, wherein each of the side panels comprises guides which slidably constrain respective side panels of the drawer, where the device basically comprises a frame and a pair of supports.

The frame has a substantially rectangular or square perimeter shape and defines at least one seat designed to support one respective container.

The frame also has two shoulders connectable to the side panels by means of the supports.

In effect, these supports are configured for reversibly connecting the frame to the side panels.

In particular, each support has a first portion, for reversible coupling of the support to a respective shoulder of the frame, and a second portion, for reversible coupling of the support to the respective side panel.

The second portion comprises at least two anchoring brackets positioned at different heights away from the first portion in such a way as to be selectively fixable to side panels equipped with different shapes.

Moreover, the technical purpose and the aims specified are achieved by an assembly kit comprising a device for carrying containers described above, a plurality of fixing elements for reversible assembly of the components of the device and for reversible assembly of the device to the drawer of the furniture item, and a plurality of containers, each reversibly insertable resting in said at least one seat of the frame of the device.

Moreover, the technical purpose and the aims specified are achieved by a furniture item comprising two side panels opposite each other and a drawer comprising two side panels, which are reversibly connected to a device for carrying containers described above. Each of the side panels comprises guides which slidably constrain the side panels of the drawer to the side panels themselves.

BRIEF DESCRIPTION OF DRAWINGS

Further features and advantages of the invention are more apparent in the non-limiting description which follows of a device for carrying containers, an assembly kit and a furniture item. The description is set out below with reference to the accompanying drawings which are provided solely for purposes of illustration without restricting the scope of the invention and in which.

DESCRIPTION OF THE PREFERRED EMBODIMENTS

Figure 1:
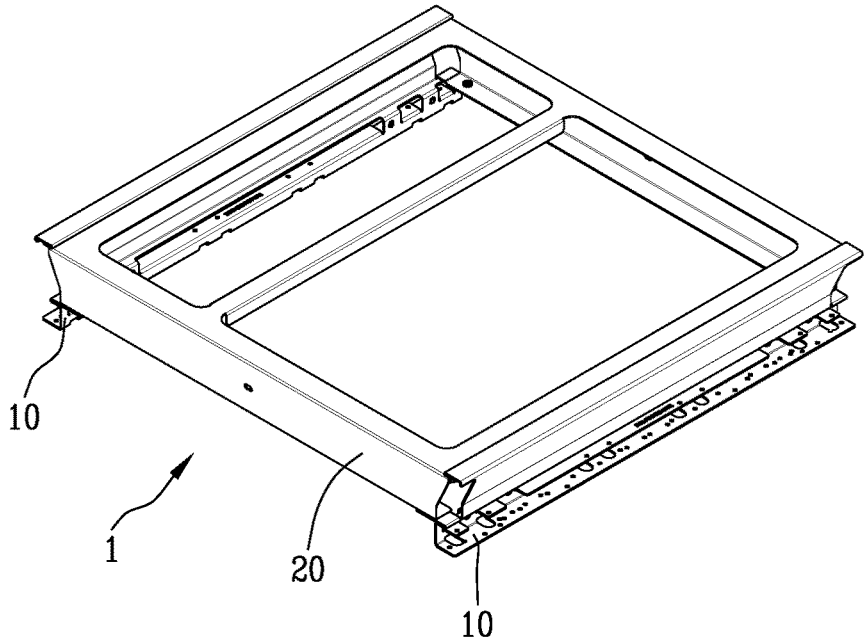
FIG. 1 is a schematic perspective view of an embodiment of a container carrying device according to the invention.

With reference to the accompanying drawings, the numeral 1 denotes in its entirety a container carrying device according to the invention.

The device 1 is installed or installable in a drawer of a furniture item 100.

Preferably, the term "furniture item" means items of furniture with a concealed drawer typically used in the home. For example, but without limiting the scope of the invention, such furniture items may be used to collect waste or dirty laundry or linen in general.

Structurally, the furniture items 100 comprise internal side panels equipped with guides which receive and slidably constrain respective side panels "S".

The device 1 is reversibly fixed on these side panels "S".

The device 1 according to the invention basically comprises a frame 20 and a pair of supports 10.

The frame 20 has a substantially rectangular or square perimeter shape and defines at least one seat designed to support at least one respective container.

In the preferred embodiment, illustrated by way of a non-limiting example, the frame 20 has two seats with different dimensions for receiving respective containers with different shapes. A same seat can accommodate more than one container.

Other embodiments of the frame 20 are possible, in which it is equipped with several seats in order to receive a greater number of containers (such as, for example, containers for the separate collection of waste).

Structurally, the frame 20 has two shoulders 21 connectable to the side panels "S" of the furniture item 100 by means of the supports 10.

The supports 10 are configured for reversibly connecting the frame 20 to the side panels "S".

Structurally, the supports 10 have a longitudinal extension substantially equivalent to the respective shoulder 21.

In particular, each support 10 has a first portion 11 for reversible coupling of the support 10 to a respective shoulder 21 of the frame 20 and a second portion 12 for reversible coupling of the support 10 to the respective side panel "S".

As illustrated, the first portion 11 defines a sliding guide 11*a* wherein the respective shoulder 21 is constrained to slide in such a way as to be able to adjust a distance between the frame 20 and the support 10.

Advantageously, by means of this feature, it is possible to install the device 1 inside furniture items 100 having a different width.

Moreover, thanks to this feature, as described in more detail below, it is possible to install the device 1 on panels with a very different shape; for example, the difference in thickness in the horizontal direction of the various types of side panels may be seen in sections 4A-4D.

Operatively, the greater the width of the furniture item 100, the greater the distance the frame 20 is fixed to relative to the support 10.

The sliding guides 11*a* are preferably positioned in such a way as to allow a horizontal sliding of the frame 20, as shown in the accompanying drawings.

Figure 3A:
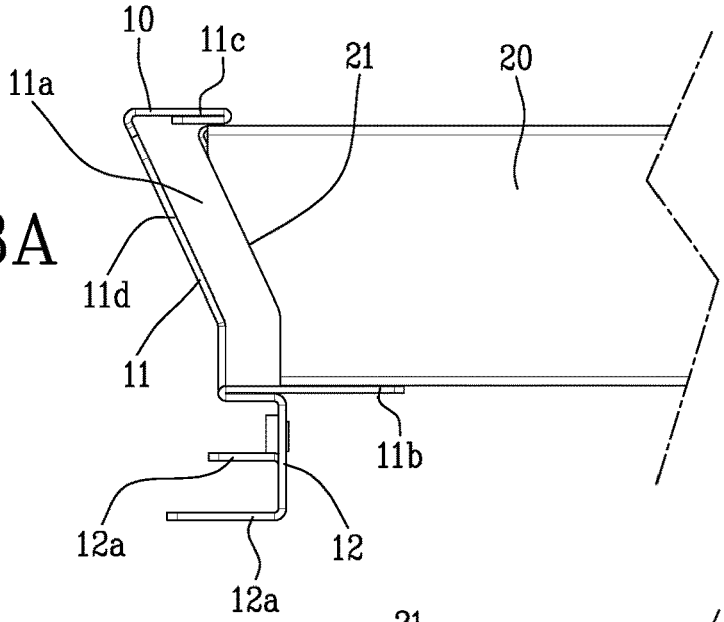
FIGS. 3A-3C are schematic views of a detail of the embodiment of the device of FIG. 1 in different operating configurations.
Figure 3B:
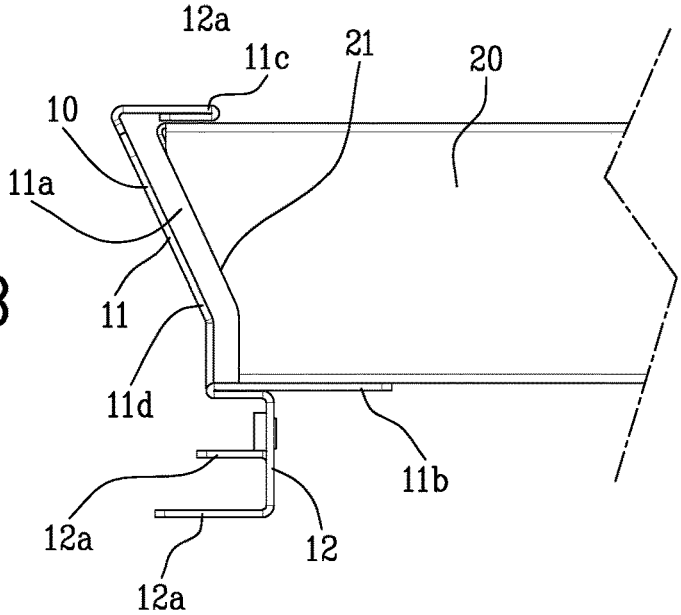
Figure 3C:
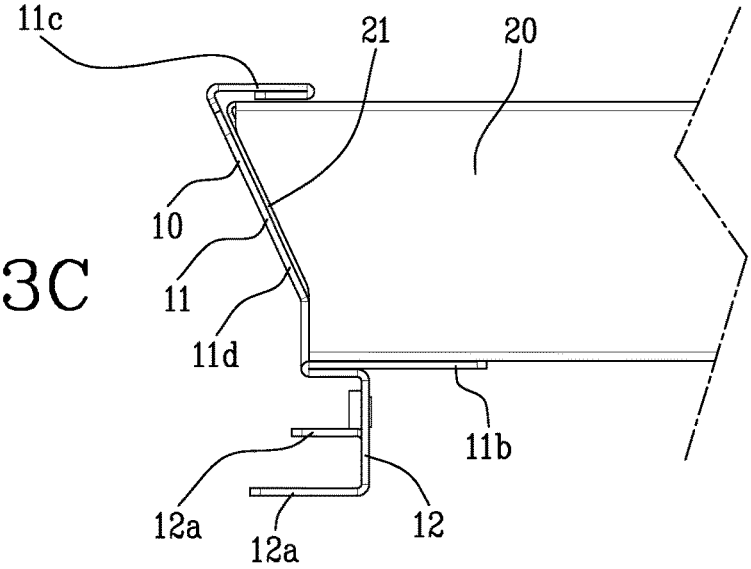
Figure 4A:
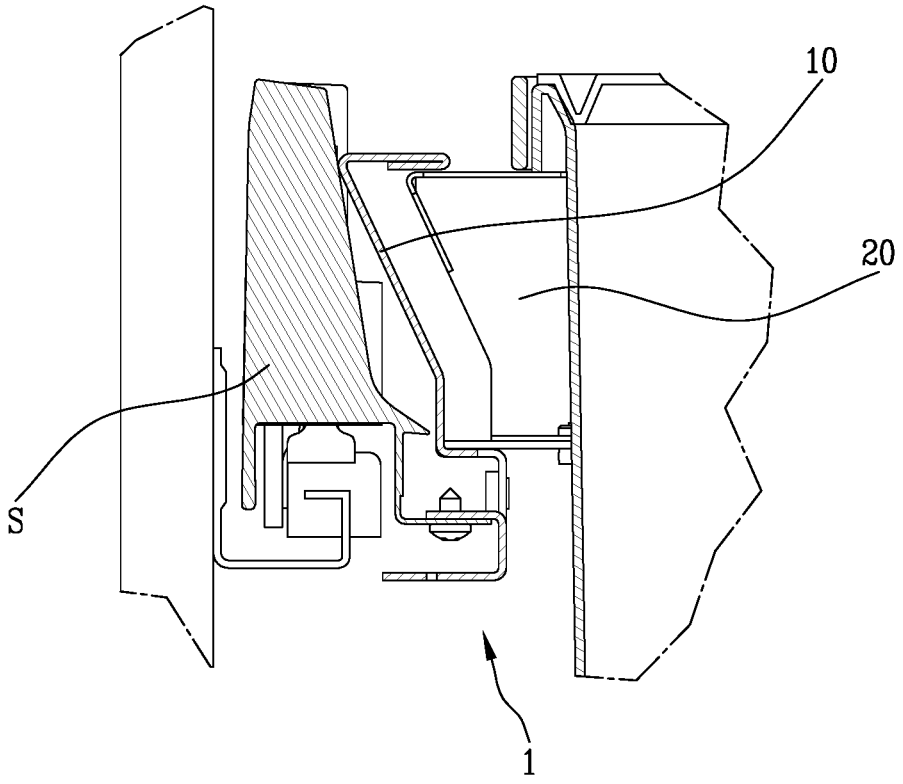
FIGS. 4A-4D are schematic views of the device of FIG. 1 installed on side panels of a furniture item having different shapes.
Figure 4B:
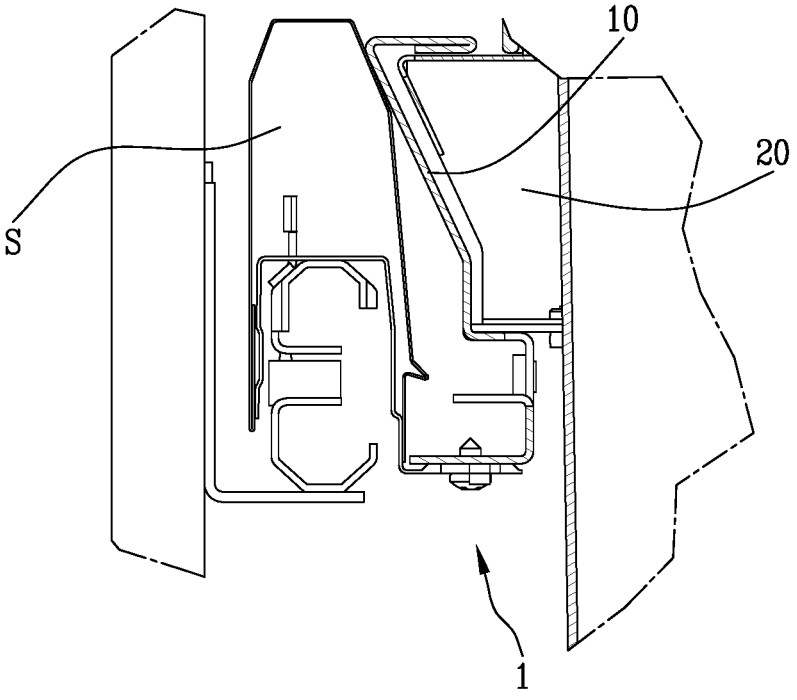
Figure 4C:
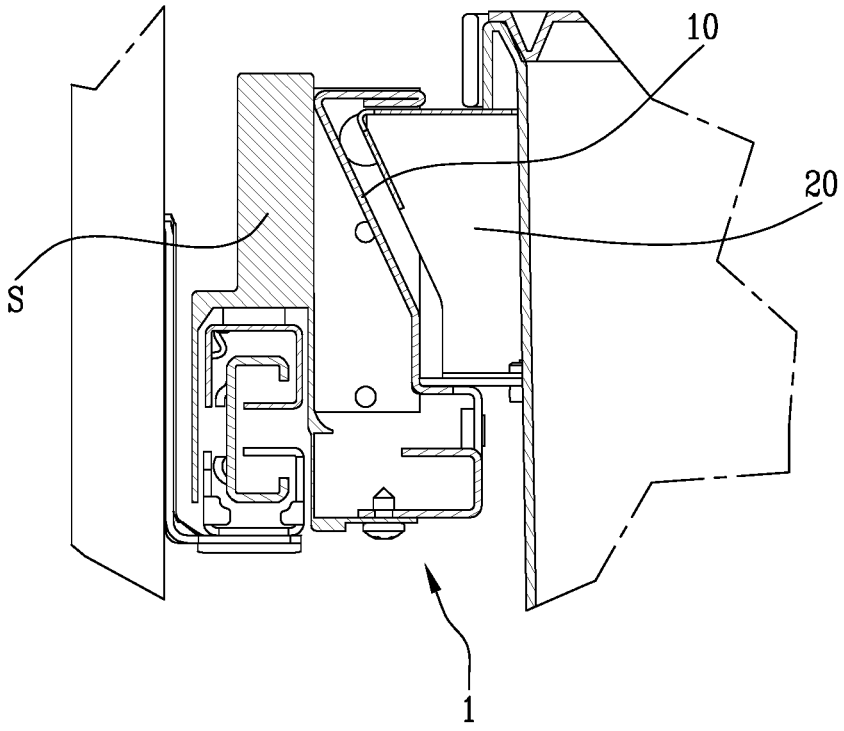
Figure 4D:
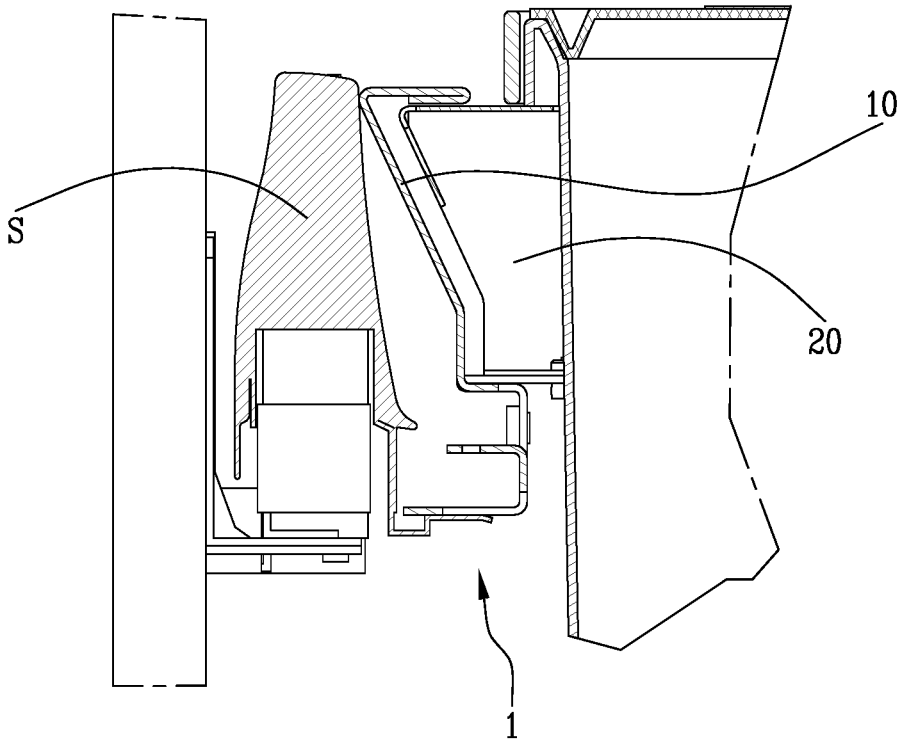

In particular, FIGS. 3A-3B show three examples of adjustment of the distance between the frame 20 and the support 10.

Preferably, the first portion 11 has a substantially "C" or similar shape.

In particular, the first portion 11 comprises a lower element 11*b* and an upper element 11*c*, parallel to each other and defining the above-mentioned sliding guide 11*a*.

Still more specifically, the lower element 11*b* and the upper element 11*c* are configured to engage, respectively, a lower edge and an upper edge of the shoulder 21.

Also, in use, according to a preferred embodiment, the lower element 11*b* supports the frame 20 in such a way as to support a weight force of the frame 20 and of the containers.

The upper element 11*c*, on the other hand, constrains the frame 20 preventing possible movements and translations which have a vertical component.

Preferably, also, the upper element 11*c* has a bent end portion which improves its mechanical properties.

Advantageously, the shape of the lower element 11*b* and of the upper element 11*c* is such that there are no slits between frame 20 and supports 10. In other words, the supports 10 are able to perform the function of lateral cover of the frame 20 in such a way as not to have side slots or openings between the frame 20 and the side panels "S".

According to another aspect of the invention, at least one between the lower element 11*b* and the upper element 11*c* has at least one adjusting slot configured to house fixing elements designed to fix the lower element 11*b* and/or the upper element 11*c* to the respective shoulder 21.

These slots have a direction of extension substantially transversal to the longitudinal extension of the support 10 and are particularly advantageous for adjusting the distance between the frame 20 and the support 10.

The slots allow a continuous adjustment of the distance between the frame 20 and the support 10.

Alternative embodiments comprise the presence of rows of through holes, made in place of the slots and extending transversally to the longitudinal extension of the support 10. These rows of holes allow a separate adjustment of the distance between frame 20 and support 10.

The first portion 11 also comprises a connecting element 11*d* of the lower 11*b* and upper 11*c* elements, at least partly shaped to match a shape of the shoulder 21 and defining an end stop or a minimum distance between the frame 20 and the respective support 10.

The second portion 12 of the support 10 is configured for reversible coupling of the support 10 to the respective side panel "S".

As illustrated, the second portion 12 comprises at least one anchoring bracket 12*a* positioned away from the first portion 11 in such a way as to be fixed to the side panel "S".

Again as illustrated, the second portion 12 comprises at least two anchoring brackets 12*a* positioned at different heights away from the first portion 11 in such a way as to be selectively fixable to side panels "S".

In particular, each bracket 12*a* can be selectively fixed to side panels "S" having different shapes.

Advantageously, by means of this feature, the supports 10 are extremely versatile and adaptable to a wide range of side panels "S" and, consequently, furniture items 100.

For example, based on the number of anchoring brackets 12*a* and/or their shape, it will be possible to connect the support 10 to a greater and different number of side panels "S".

FIGS. 4A-4D show the coupling of the support 10 to various embodiments of side panels "S".

Preferably, the second portion 12 comprises two anchoring brackets 12*a* and has the shape of an upturned "F".

Alternative embodiments, however, are not excluded from the invention wherein the second portion 12 comprises three or more anchoring brackets 12*a*.

Preferably, the anchoring brackets 12*a* are reciprocally parallel and, in use, are substantially oriented horizontally.

Figure 2A:
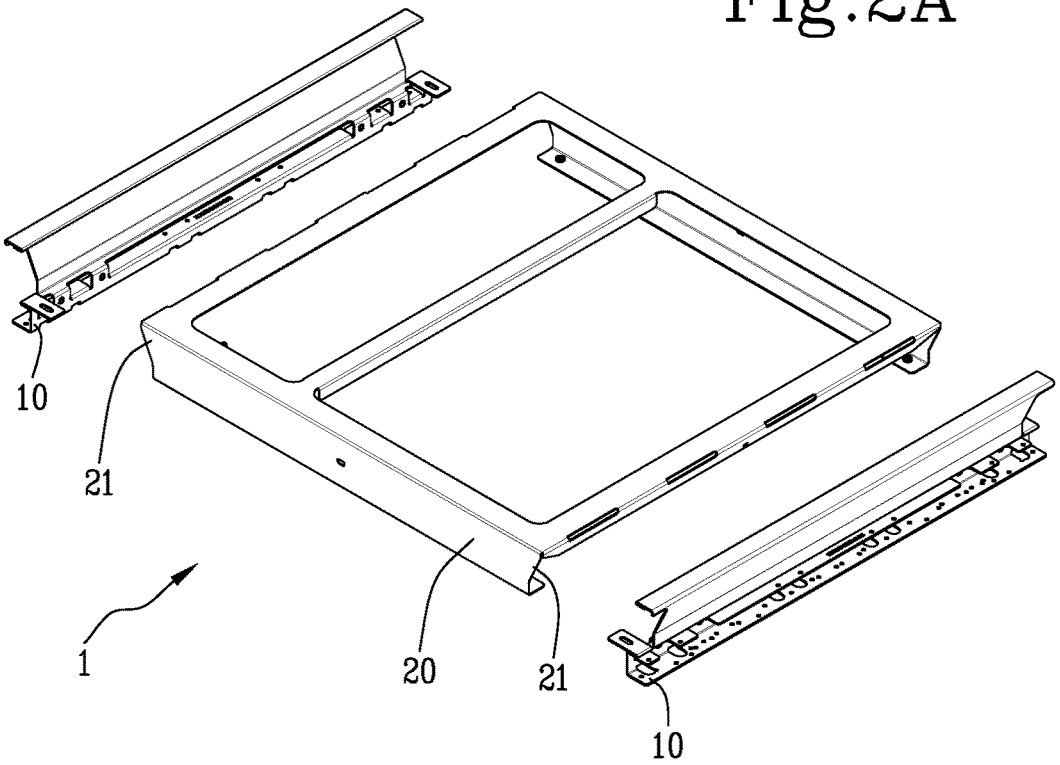
FIG. 2A is a schematic exploded view of the embodiment of the container carrying device of FIG. 1.
Figure 2B:
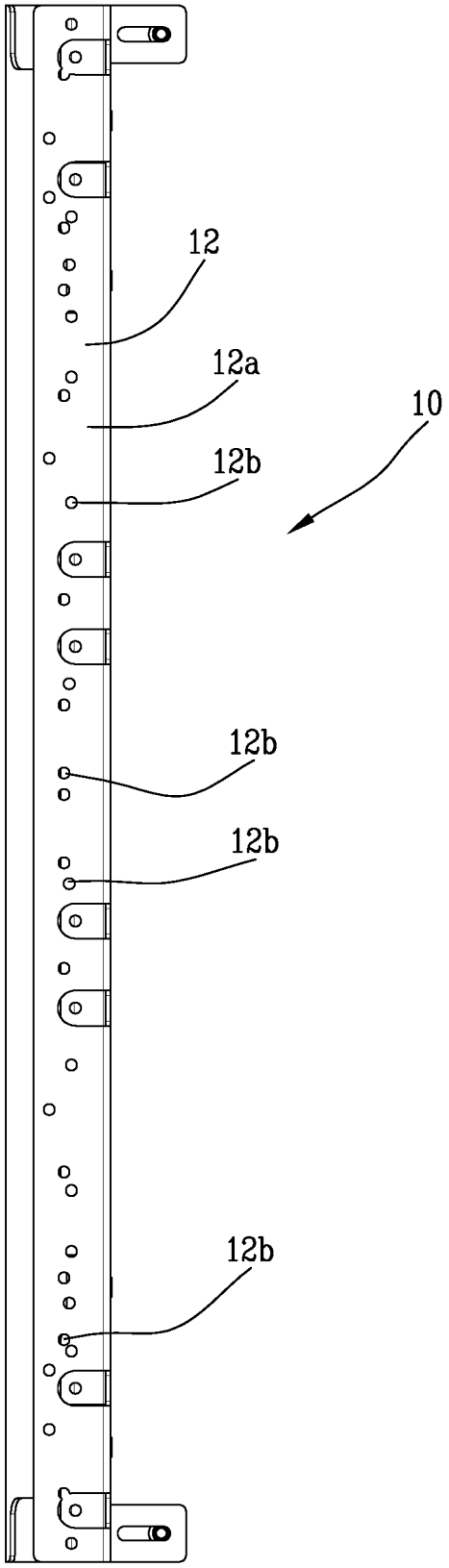
FIG. 2B is a view of a detail of the embodiment of the device of FIG. 1.

According to another aspect, as illustrated in FIG. 2B, the anchoring brackets 12*a* have a plurality of through holes 12*b* configured to house respective fixing elements designed to fix the respective anchoring bracket 12*a* to the respective side panel "S".

In particular, the through holes 12*b* are made on the anchoring brackets 12*a* for the entire longitudinal extension of the support 10.

Moreover, the through holes 12*b* are made in number and according to a distribution such as to make the support 10 particularly versatile and universal, that is to say, which can be used with different types of side panels "S".

As shown in FIG. 2B, the through holes 12*b* preferably have an irregular distribution.

According to another aspect, the first portion 11 is preferably configured to come into contact with the side panel "S".

Advantageously, this feature makes it possible to improve the appearance of the furniture item 100.

According to another aspect of the invention, the upper element 11*c*, the lower element 11*b* and the at least two anchoring brackets 12*a* are mutually parallel and, in use, are substantially oriented horizontally.

According to another aspect, the first and second portions 11, 12 are made preferably in one piece. In particular, each support may be made from a sheet which is cut and folded or molded.

According to another aspect of this invention, the supports 10 of the pair of supports 10 are identical to each other and, in use, positioned specularly relative to the frame 20.

Advantageously, this feature makes the installation of the device 1 particularly intuitive and, consequently, less onerous in terms of time.

The invention also relates to a kit comprising the device 1 for carrying containers as described above and a plurality of fixing elements for reversible assembly of the components of the device 1 and for reversible assembly of the device 1 in the drawer of the furniture item 100. The kit also comprises a plurality of containers. Each container can be reversibly inserted resting on the at least one seat of the frame 10.

Figure 5:
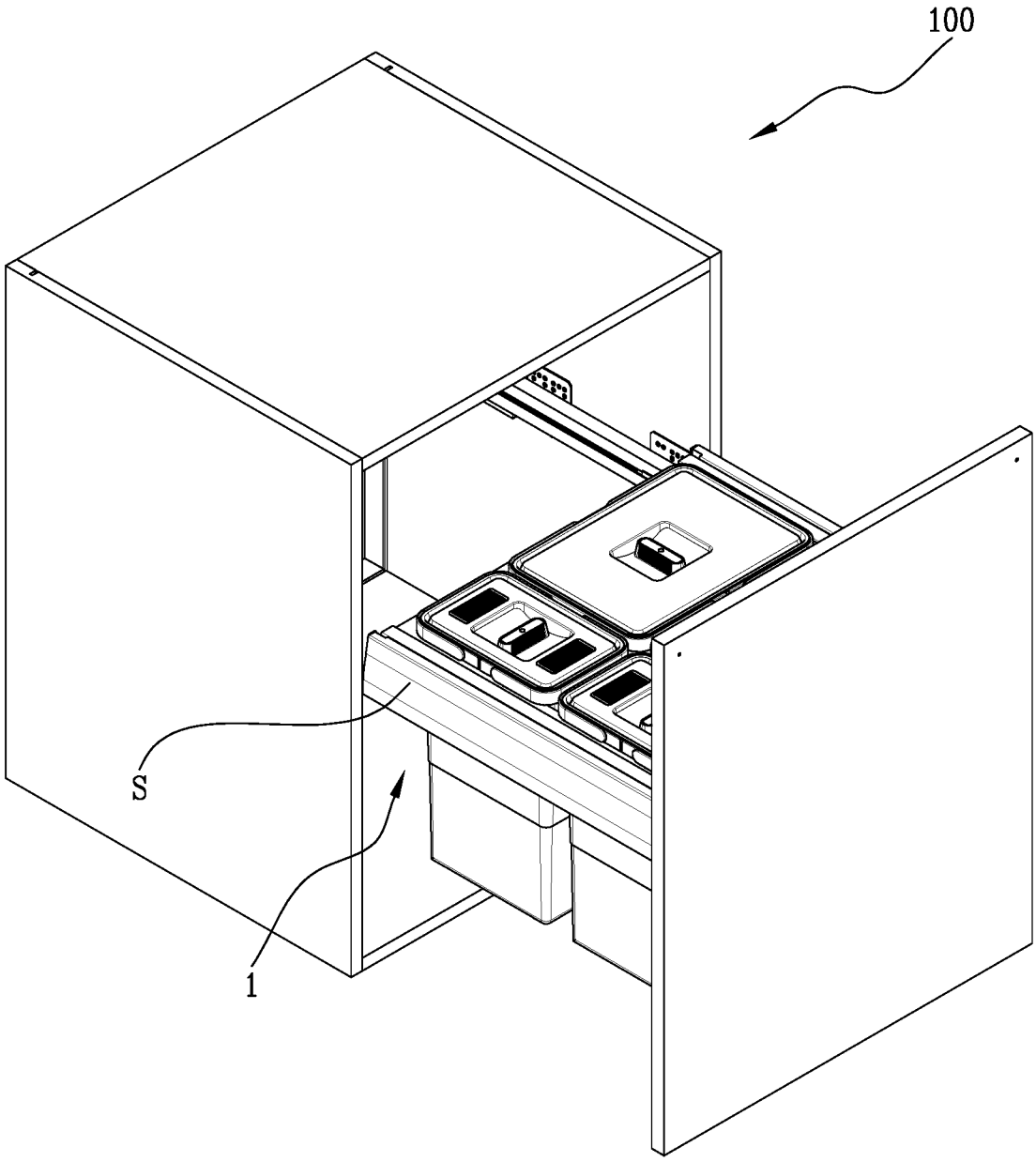
FIG. 5 is a schematic perspective view of an example embodiment of a furniture item on which the device is installed.

Moreover, the invention relates to a furniture item 100, illustrated in FIG. 5, comprising the kit, that is, the device 1.

Structurally, the furniture item 100 comprises inner side panels equipped with guides configured to receive and constrain in a sliding fashion respective side panels "S" to which, by means of fixing elements, the device 1 is reversibly fixed. In this way, the furniture item 100 is able to receive a number of containers for storing waste or for other aims such as, for example, containing dirty laundry and the like. Moreover, the containers housed therein can be easily extracted from the frame 10.

Advantageously, the device 1, the assembly kit and the furniture item 100 described above are able to overcome the drawbacks of the prior art.

In particular, an aim achieved is to provide a device 1 which is able to be extremely versatile in such a way that it can be coupled to a wide type of side panels "S" and, consequently, can be installed in a wide range of furniture items 100.

This aim is achieved thanks to the presence of the at least two anchoring brackets 12*a* which allow the support 10 to adapt to a plurality of embodiments of the side panels "S".

Moreover, this aim is achieved by means of the plurality of through holes 12*b* made on the respective anchoring brackets 12*a* with a quantity and distribution such as to allow a spot adaptation of the support 10 to the respective side panel "S".

A further aim achieved is to provide a device 1 which can be easily and intuitively installed in a furniture item 100.

This aim is achieved thanks to the basic structure of the supports 10 and the fact that the supports 10 are identical and can be mounted specularly.

Advantageously, the invention provides an assembly device 1 and kit wherein the adjustment between the supports 10 and the frame 10 is adaptable to the various shapes and dimensions of the profiles of the side panels "S" and for the adaptation to the various thicknesses of the side panels of the furniture items 100.

What is claimed is:

1. A container carrying device, configured to be installed in a drawer of a furniture item having two side walls opposite to each other, wherein the side walls include guides which slidably constrain side panels of the drawer, the container carrying device comprising:

a frame having a substantially rectangular or square perimeter shape and defining at least one seat configured to support a container; said frame having two shoulders;

a pair of supports configured for reversibly connecting said frame to said side panels; each said support having a first portion configured for reversible coupling the support to one said shoulder of said frame, and a second portion, configured for reversible coupling the support to one said side panel, wherein each said second portion comprises at least one anchoring bracket positioned away from said first portion and configured to be fixable to one said side panel, and wherein the first portion defines a sliding guide wherein the one said shoulder is constrained to slide, during assembly, and configured to adjust a distance between said frame and one said support;

wherein said first portion is substantially C-shaped and comprises a lower element and an upper element, parallel to each other and defining said sliding guide, and configured to engage, respectively, with a lower edge and an upper edge of one said shoulder; and wherein the at least one anchoring bracket includes two said anchoring brackets positioned at different heights from each other and away from said first portion to be selectively fixable, either one or the other, to one said side panel in use.

2. The container carrying device according to claim 1, wherein each of the anchoring brackets has a plurality of holes for housing fixing elements configured to fix said anchoring bracket to one said side panel.

3. The container carrying device according to claim 1, wherein said first coupling portion also comprises an element for connecting said lower and upper elements, at least partly shaped to match a shape of said shoulder and defining an end stop of a minimum distance between said frame and said support.

4. The container carrying device according to claim 1, wherein at least one chosen from said lower element and said upper element has an adjustment slot configured to house fixing elements configured to fix said lower element and/or said upper element to the shoulder.

5. The container carrying device according to claim 1, wherein said upper element, said lower element and said two anchoring brackets are mutually parallel.

6. The container carrying device according to claim 1, wherein said first and second portions of each said support of said pair of supports are made in one piece.

7. The container carrying device according to claim 1, wherein said pair of supports are identical to each other and positioned specularly relative to said frame.

8. An assembly kit comprising:

the container carrying device according to claim 1;

a plurality of fixing elements configured for reversible assembly of said container carrying device and configured for reversible assembly of the container carrying device to the drawer of said furniture item; and a plurality of containers, each said container reversibly insertable resting in said at least one seat of the frame.

9. A furniture item comprising two side walls which are opposite each other and a drawer comprising two side panels, which are reversibly connected to the device for carrying containers according to claim 1, each of said side walls comprising guides which slidably constrain said side panels of the drawer to the side walls.

* * * * *